US007588479B2

(12) United States Patent
Falla

(10) Patent No.: US 7,588,479 B2
(45) Date of Patent: Sep. 15, 2009

(54) FRONT CLOSURE BRASSIERE HAVING DYNAMIC ADJUSTABLE SECTION

(75) Inventor: Gloria Falla, Demarest, NJ (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 0 days.

(21) Appl. No.: 11/169,200

(22) Filed: Jun. 28, 2005

(65) Prior Publication Data

US 2006/0009124 A1 Jan. 12, 2006

Related U.S. Application Data

(60) Provisional application No. 60/583,528, filed on Jun. 28, 2004.

(51) Int. Cl.
*A41C 3/00* (2006.01)

(52) U.S. Cl. ..... 450/75; 450/74

(58) Field of Classification Search ..... 450/58, 450/62, 63, 74–77, 79, 82–85, 8, 12–18, 450/23; 2/73, 78.1–78.4
See application file for complete search history.

(56) References Cited

U.S. PATENT DOCUMENTS

| | | | | | |
|---|---|---|---|---|---|
| 911,204 | A | | 2/1909 | Busby | |
| 1,288,927 | A | * | 12/1918 | Kops | 450/79 |
| 1,290,608 | A | | 1/1919 | Lowman | |
| 1,670,684 | A | | 5/1928 | Leuchtag | |
| 1,804,855 | A | | 5/1931 | Bollwine | |
| 1,875,201 | A | | 8/1932 | Weber | |
| 2,266,518 | A | | 12/1941 | Sarge | |
| 2,327,488 | A | | 8/1943 | Becker | |
| 2,449,808 | A | * | 9/1948 | Glick | 450/79 |
| 2,497,938 | A | | 2/1950 | Friedman | |
| D161,439 | S | | 1/1951 | Glick | |
| 2,630,572 | A | | 3/1953 | Gluckin et al. | |
| 2,688,748 | A | | 9/1954 | Kahn | |
| 2,715,225 | A | | 8/1955 | Gould | |
| 2,760,199 | A | | 8/1956 | Champagne | |
| 2,762,052 | A | | 9/1956 | Olsen | |
| 2,794,986 | A | | 6/1957 | Anderson | |
| 2,800,659 | A | | 7/1957 | Hazard | |
| 2,800,902 | A | | 7/1957 | Wiltrout | |
| 2,866,462 | A | | 12/1958 | Faron | |
| 2,882,905 | A | | 4/1959 | Barg | |
| 2,888,931 | A | * | 6/1959 | Schaumer | 450/58 |
| 2,949,115 | A | | 8/1960 | Phillips | |
| 3,040,750 | A | | 6/1962 | Hurwitz | |
| 3,066,676 | A | * | 12/1962 | Kaupp | 450/58 |
| 4,411,269 | A | * | 10/1983 | Weintraub | 450/58 |
| 4,741,719 | A | | 5/1988 | Wirth | |
| 4,804,351 | A | | 2/1989 | Raml | |
| 4,816,005 | A | | 3/1989 | Braaten | |
| 5,823,851 | A | | 10/1998 | Dicker | |
| 6,165,045 | A | | 12/2000 | Miller | |
| D475,506 | S | | 6/2003 | Hoffman | |
| D475,835 | S | | 6/2003 | Hoffman | |

* cited by examiner

*Primary Examiner*—Gloria Hale
(74) *Attorney, Agent, or Firm*—Womble Carlyle Sandridge & Rice, PLLC

(57) ABSTRACT

A brassiere having a front opening and a dynamic adjustable back section and a first side panel and a second side panel is provided. The brassiere also has a pair of breast receiving cups and a connector between the breast receiving cups for selectively opening and selectively closing the brassiere. The dynamic adjustable back section elongates from a first length to a second length to automatically adjust a size of the brassiere.

13 Claims, 6 Drawing Sheets

FRONT CLOSURE BRASSIERE HAVING DYNAMIC ADJUSTABLE SECTION

This application claims the benefit of U.S. Provisional Patent Application Ser. No. 60/583,528 filed on Jun. 28, 2004, the contents of which are incorporated by reference herein.

BACKGROUND OF THE INVENTION

1. Field of the Invention

The present invention relates to a garment. More particularly, the present invention relates to a brassiere or bra having a front closure and a dynamic adjustable section in a rear portion of the brassiere.

2. Description of the Related Art

There exist in the art of brassieres, brassieres with a front closure device and others with a rear closure device. A front closure brassiere is closed in the front or normally between the breast cups. A rear closure brassiere is closed in a rear or opposite the breast cups. The rear closure brassiere has some adjustability or device in the rear of the brassiere to adjust the garment around the torso of the wearer. Front closure brassieres do not have a device to adjust the fit around the torso that would reduce the aesthetic appeal of the garment.

A front closure brassiere is disclosed in U.S. Pat. No. 4,411,269 to Weintraub. Weintraub discloses a brassiere with a manually adjustable static friction device located on a rear strap for selectively adjusting a length of a back strap around the torso of the wearer. While the garment can be adjusted around the torso, the device only provides static adjustment. Repeated removal and manual adjustments of the brassiere are required to obtain a comfortable fit. Further, the friction device is in contact with the wearer's skin. A pulling force that may be needed to close the brassiere around the torso as well as active everyday movement may cause the device to rub or press against the wearer's skin and, thus, possibly cause redness and chafing of the skin.

Accordingly, there is a need for a garment that provides dynamic automatic adjustability around the torso of the wearer and comfort during movement.

BRIEF SUMMARY OF THE INVENTION

It is an object of the present invention to provide a brassiere having a front opening that can easily be applied and removed from a wearer.

It is another object of the present invention to provide a brassiere having a front opening with a front closure.

It is still another object of the present invention to provide a brassiere that has a front opening with a dynamic adjustment section that automatically adjusts to fit the brassiere around a torso of the wearer.

It is yet another object of the present invention to provide a brassiere that has a front closure with a dynamic adjustment section having a first elastic adjustment section and a second elastic adjustment section both in a rear of the brassiere.

It is a further object of the present invention to provide a brassiere that has a dynamic adjustment section having a first adjustment section and a second adjustment section with at least one of the first adjustment section and the second adjustment section made from an elasticized material.

It is still a further object of the present invention to provide a brassiere that has a dynamic adjustment section that automatically adjusts to fit a wearer with a first adjustment member and a second adjustment member disposed in an overlapping, crisscross arrangement with at least one of the members being made from an elasticized material.

It is yet a further object of the present invention to provide a brassiere that has a front opening with a front closure that automatically and self adjusts around the torso of the wearer without any need to remove the brassiere or manipulate any device in a rear of the brassiere.

These and other objects and advantages of the present invention are achieved by a brassiere of the present invention. The brassiere has a first side panel and a second side panel. A pair of breast cups are preferably connected to the first and the second side panels. A connector is between the first breast cup and the second breast cup for selectively opening and selectively closing the brassiere. The brassiere also has a dynamic adjustment section between the first side panel and the second side panel that has at least one elastic member for selectively and automatically elongating from a first length to a second length in response to a size of a wearer. Thus, a brassiere with this dynamic adjustment section is conducive to an active and/or average or full-figured individual.

DETAILED DESCRIPTION OF THE INVENTION

Figure 1:
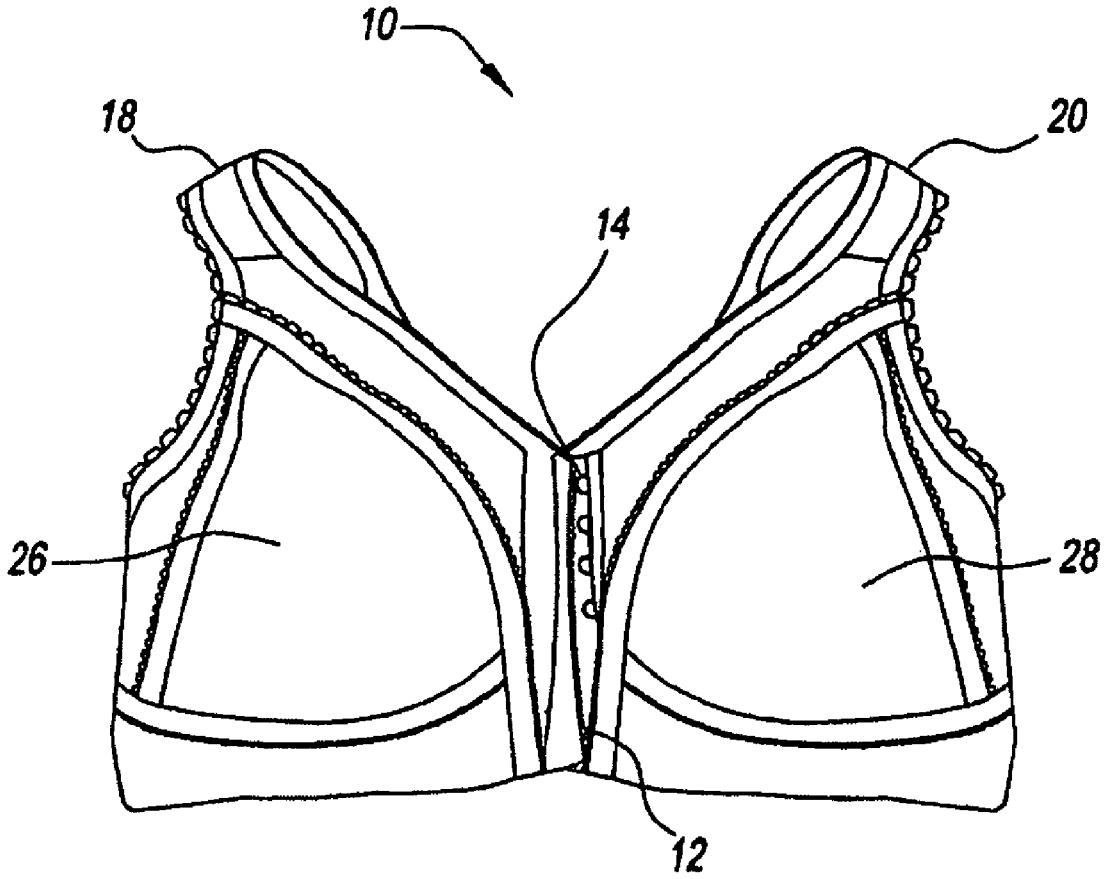
FIG. 1 is a front view of a brassiere in a closed position of the present invention.

Referring to the drawings and, in particular, to FIG. 1, there is shown a brassiere of the present invention generally represented by reference numeral 10. Most preferably, the brassiere 10 provides an automatic size adjustment while simultaneously persevering the appearance of the brassiere. The brassiere 10 has a front opening 12 and a closure device 14. One skilled in the art should appreciate that the closure device 14 may have mating or cooperative portions commonly known in the art.

Brassiere 10 preferably has a first strap 18 and a second strap 20. Both the first strap 18 and the second strap 20 are connected to a torso encircling structure, that for explanation purposes will be called a first side panel 22 and a second side panel 24. Brassiere 10 has a first breast cup 26 and a second breast cup 28. Closure device 14 is preferably between the first breast cup 26 and the second breast cup 28. One skilled in the art should appreciate that the first and the second breast cups 26, 28, respectively, may be made from any suitable material known in the art and may be in any suitable size to accommodate a wearer's proportions.

Figure 2:
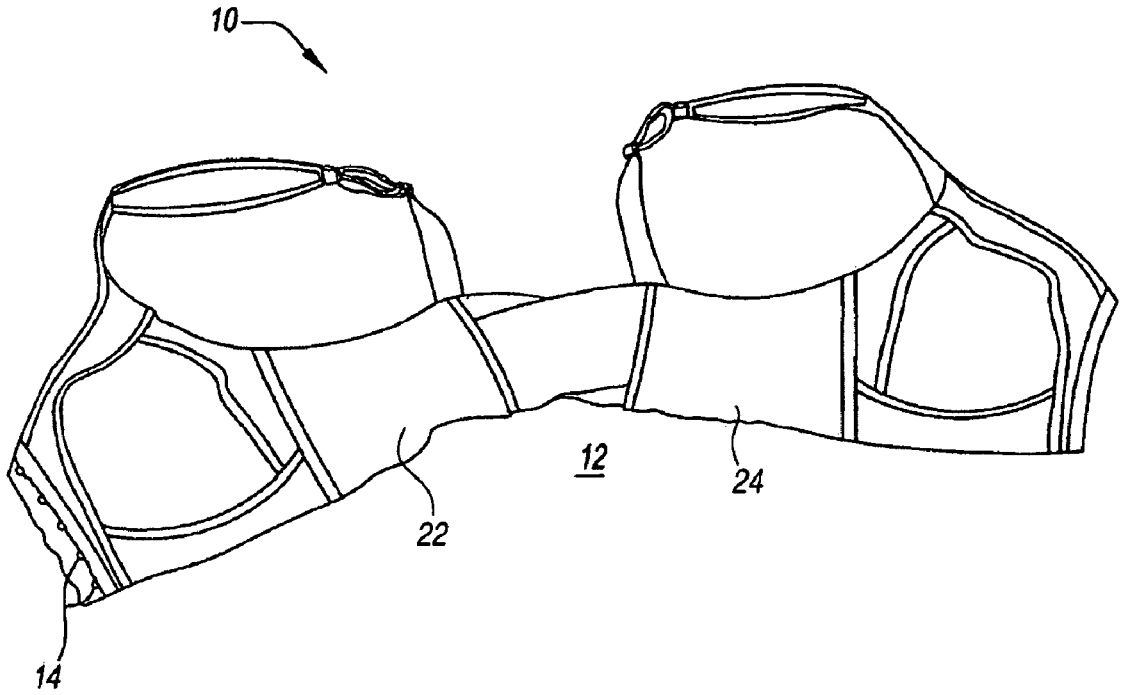
FIG. 2 is a front view of the brassiere of FIG. 1 in an opened position.

Referring to FIG. 2, brassiere 10 is in an opened position. When brassiere 10 is being worn, the wearer will pull the first side panel 22 and the second side panel 24 together in contact with one another. The wearer will then close the closure device 14 as shown in FIG. 1 to close the front opening 12 of brassiere 10.

Figure 3:
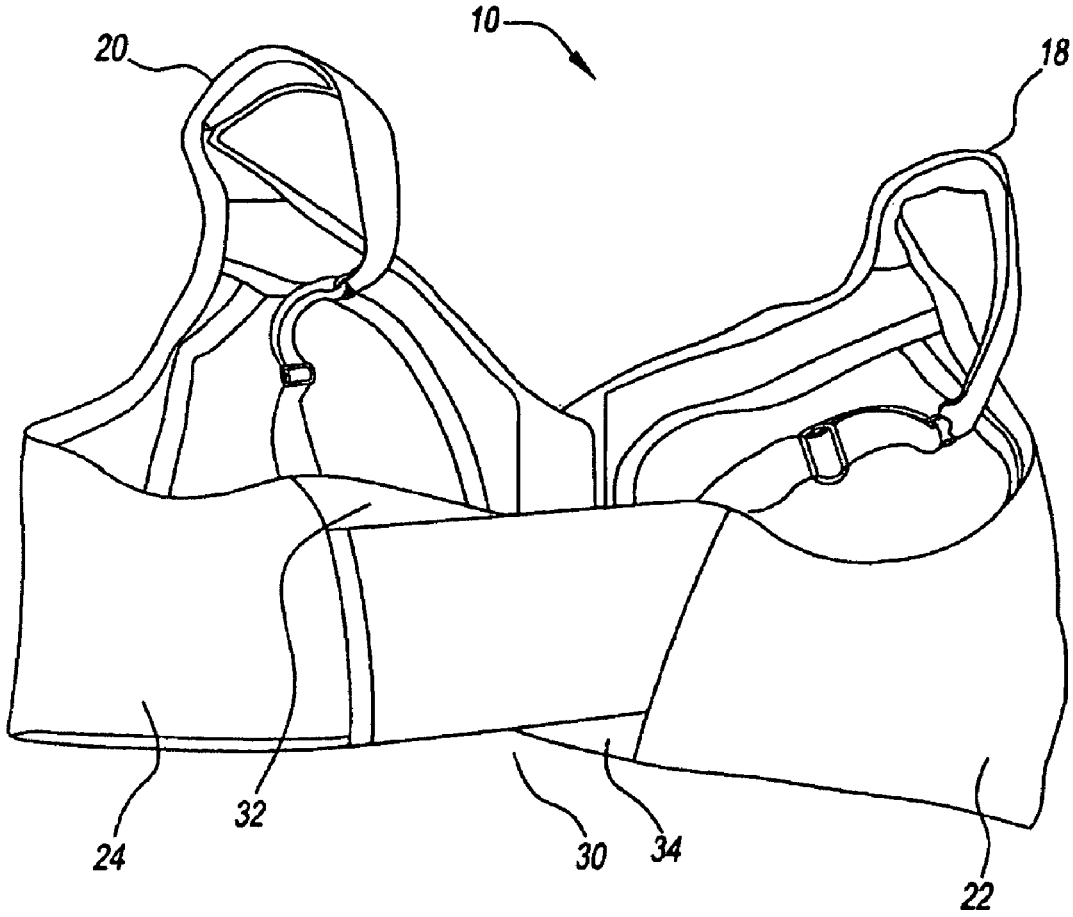
FIG. 3 is a rear view of the brassiere of FIG. 1.

Referring to FIG. 3, brassiere 10 has a dynamic adjustable section 30. The dynamic adjustable section 30 preferably has a first side 32 and a second side 34 opposite the first side. The first side 32 of the dynamic adjustable section 30 is connected to the second side panel 24. The second side 34 is connected to the first side panel portion 22. The arrangement preferably allows the dynamic adjustable section 30 to be comfortably positioned about the wearer and in contact with the back of the wearer opposite the breast tissues without causing any rubbing or chafing. Alternatively, the dynamic adjustable section 30 may be in other locations, such as, for example on the lateral sides of the wearer. First side 32 and second side 34 of dynamic adjustable section 30 are preferably connected to the second side panel 24 and first side panel 22, respectively, by a stitching operation.

Preferably, the dynamic adjustable section 30 has two sections. Each section is an elastic material or an elastomeric type material, such as, for example, a powernet. Alternatively, the dynamic adjustable section 30 may have more than two sections of elastic material or elastomeric type material, such as for example, powernet.

When brassiere 10 is being donned, the dynamic adjustable section 30 preferably elongates from a first length to a second length. This elongation preferably changes a circumference of brassiere 10 about the torso of the wearer.

Figure 4:
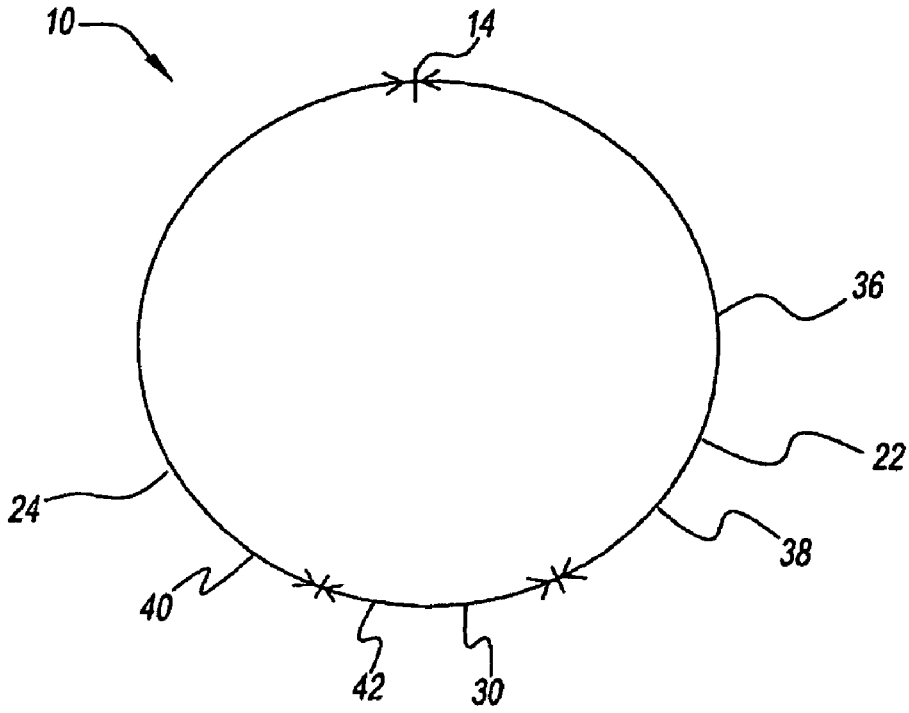
FIG. 4 is a schematic top view of the brassiere of FIG. 1 in an initial state.

Referring to FIG. 4, in an unworn or relaxed state, brassiere 10 has a first circumference 36. The first circumference 36 is preferably measured from a sum of a first length 38 of the first side panel 22, a second length 40 of the second side panel 24, and a third initial length 42 of the dynamic adjustable section 30.

Figure 5:
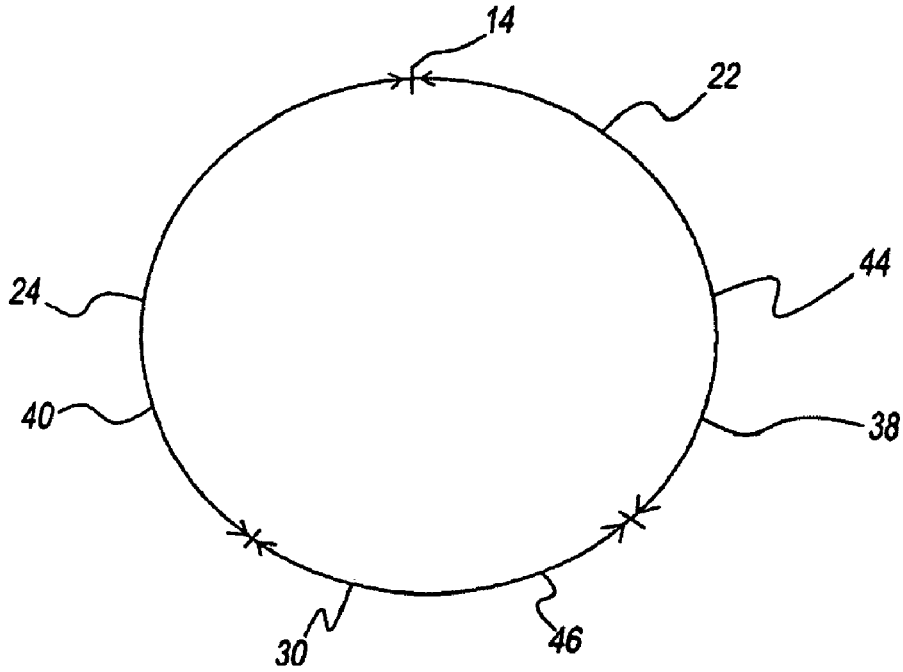
FIG. 5 is a schematic top view of the brassiere with the dynamic adjustment section in a second elongated state.

Referring to FIG. 5, when brassiere 10 is donned and worn, the dynamic adjustable section 30 will provide a second circumference 44 where the brassiere fits around the torso of the wearer. The second circumference 44 is measured from a sum of the first length 38 of the first side panel 22, the second length 40 of the second side panel 24, and a fourth elongated length 46 of the dynamic adjustable section 30. This sizing change preferably occurs in a dynamic manner that happens without any manual wearer operation while the brassiere 10 is donned and worn. The dynamic adjustment section 30 obviates any need for removal the brassiere 10 for size adjustment.

One skilled in the art will also appreciate that dynamic adjustable section 30 readily accommodates fluctuations in breast and/or torso size resulting from monthly menstrual cycles or slight weight gain or loss. Dynamic adjustable section 30 allows the woman to wear the same brassiere throughout the month and maintain a desired level of appearance, comfort and support without compromise. Furthermore, the dynamic adjustable section 30 allows for continual multidirectional support as the wearer moves in different directions.

Figure 6:
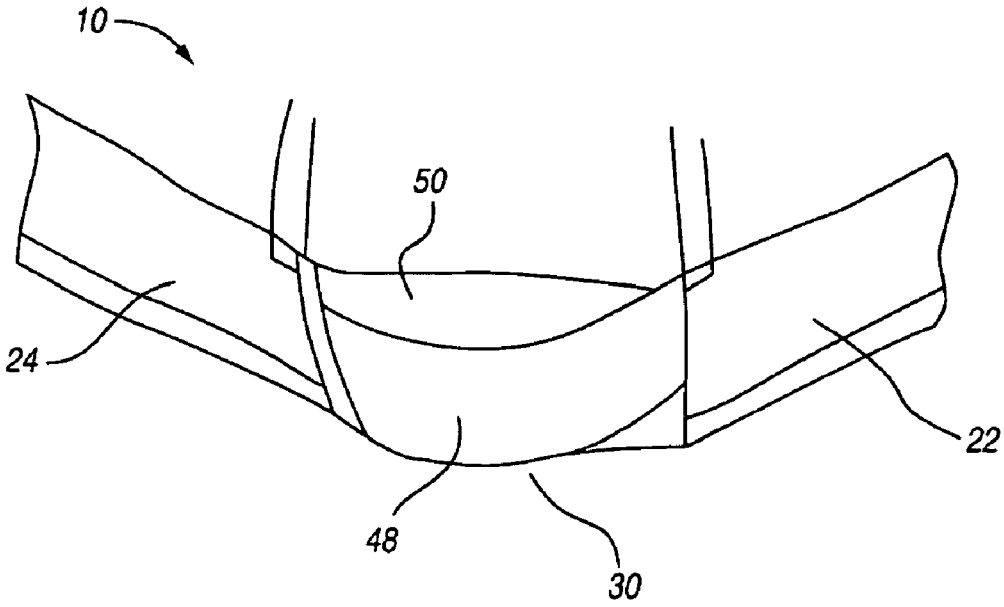
FIG. 6 is a top perspective view of the brassiere of FIG. 1 showing the dynamic adjustment section with a first adjustment member and a second adjustment member.

Referring now to FIG. 6, one skilled in the art should appreciate that although the dynamic adjustable section 30 shown is made from an elastic material, the dynamic adjustable section may be made from one or more elastomeric yarns, spandex, bare elasthane, nylon elasthane, polyester elasthane, or any combinations thereof.

Preferably, the dynamic adjustable section 30 has the first normal state, the second elongated state, and a number of elongated states therebetween. Upon the wearer stretching the brassiere around torso by pulling both the first side panel 22 and the second side panel 24 together an amount to manipulate the closure device 14, the dynamic adjustable section 30 will also be pulled. Upon being pulled, the dynamic adjustable section 30 will elongate from the relaxed state to the stretched state to accommodate a desired size of the wearer. This will cause the dynamic adjustable section 30 to expand a certain amount and, thus, improve an overall fit of the brassiere around the wearer.

Preferably, the dynamic adjustable section 30 has a first member 48 and a second member 50. First member 48 and second member 50 are elasticized along their longitudinal axes. First member 48 and second member 50 are positioned relative to one another in a crisscross arrangement as shown in FIG. 2. When first member 48 and second member 50 are in a crisscrossed arrangement, dynamic adjustable section 30 can flex in both lateral and longitudinal directions to provide for active movement such as during physical activity. One skilled in the art should appreciate that the first member 48 is positioned on the second member 50. Alternatively, the second member 50 may be over the first member 48, or they may be positioned in parallel side-by-side relation relative to one another, as shown in FIG. 7A.

The first member 48 may have a first modulus of elasticity and the second member 50 may have a second modulus of elasticity, with the first modulus of elasticity and the second modulus of elasticity being the same or different relative to one another. Most preferably, the first modulus of elasticity and the second modulus of elasticity are both lower than any modulus of elasticity of the first side panel 22 and the second side panel 24 so the both the first member 48 and the second member 50 will be more elastic than the first side panel and the second side panel and elongate as desired.

Figure 7:
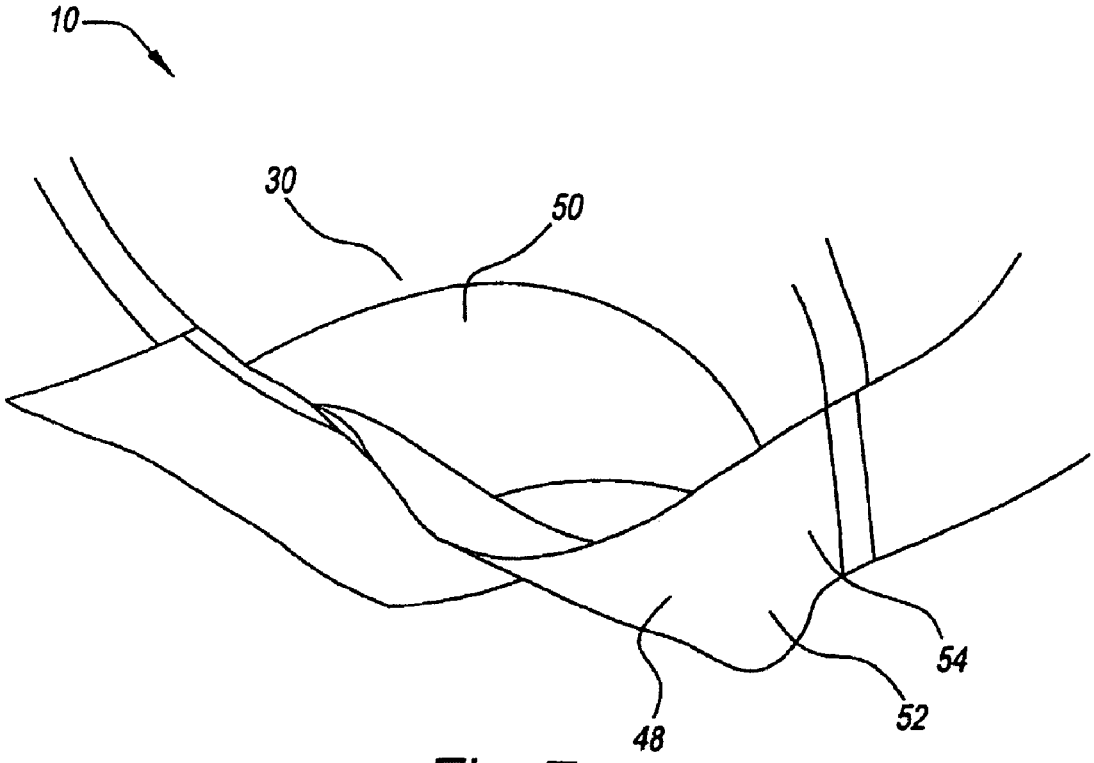
FIG. 7 is a close up view of the dynamic adjustment section of FIG. 6.
Figure 7A:
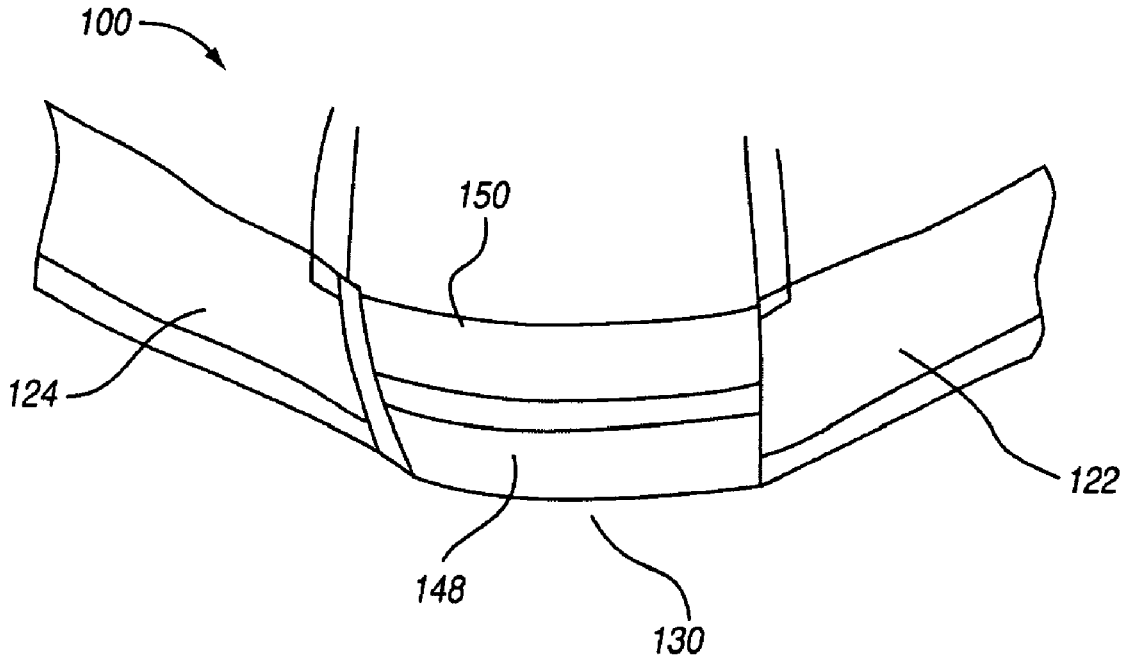

Referring to FIG. 7, there is shown a close up view of the dynamic adjustable section 30 having the first member 48 and the second member 50. Preferably, the first member 48 and the second member 50 are positioned in a rear of the brassiere 10 arranged in a substantially "X" shaped arrangement relative to one another. Preferably, a location of the first member 48 and the second member 50 is in a complementary location relative to a middle and an upper back of the wearer opposite the breast tissues, and provides elasticity and support to adjust the brassiere in a dynamic and comfortable manner. One skilled in the art should appreciate that the dynamic adjustable section 30 is placed so as to be in a complementary location of the wearer's back.

One skilled in the art should appreciate that the size of the first member 48 and the second member 50 may vary depending upon size of the brassiere 10. In one embodiment, each of the first member 48 and second member 50 have a length of about four inches and a width of about three inches to three and one half inches. Each of the first member 48 and the second member 50 further preferably has a thickness of less than about one sixteenth of an inch. However, one skilled in the art should appreciate that the first member 48 and the second member 50 may be formed with any length, width and thickness. Varied dimensions of first member 48 and second member 50 will accommodate women having fuller figures. Each of the first member 48 and the second member 50 is preferably lightweight and allows the brassiere to be used as a sports brassiere. Each of the first member 48 and the second member 50 also preferably has a smooth wearer contacting surface so as to avoid any chafing or rubbing during everyday wear or active movement.

Brassiere 10 may be a cut and sewn brassiere as is known in the art. Breast cups 26 and 28 can be formed by methods commonly known in the art such as by molding, stretch molding, cutting and sewing, or circularly knitting. Breast cups 26 and 28 may be made from cotton, nylon, one or more elastic or inelastic yarns, or any other material known in the art. Side panels 22 and 24 and underbust support are preferably made from a material manufactured under the trade name "Spannette". Alternatively, the side panels and underbust support may be made from cotton, nylon, one or more elastic or inelastic yarns, or any other material known in the art. Preferably, the closure device 14 is formed from a suitable resilient material, such as a thermoplastic or a metal, and is durable and capable of repeated usage. The closure device 14 may be one or more hook and loop fasteners, one or more buttons, one or more hook and eye fasteners, one or more clasps, a zipper, or any other closure device known in the art. The closure device 14 preferable allows the wearer to selectively open and selectively close the brassiere 10 in a comfortable manner without any abrasions or uncomfortable sensation.

Turning to FIG. 7A, an alternative embodiment of the dynamic adjustable section 130 is shown. Rather than being configured in an "X" shaped arrangement relative to one another, in some applications the first elasticized member 148 and the second elasticized member 150 are arranged in a parallel side-by-side relation. As in the embodiment described above, the relative size (width) of the first member 148 and second member 150 may vary depending upon the size of the brassiere 100. In all other respects, however, the first side panel 122 and the second side panel 124 may again be pulled together an amount sufficient to elongate the dynamic adjustable section 130 from a relaxed state to a stretched state to accommodate the size of the wearer.

It should be understood that the foregoing description is only illustrative of the present invention. Various alternatives and modifications can be devised by those skilled in the art without departing from the invention. Accordingly, the present invention is intended to embrace all such alternatives, modifications and variances.

I claim:

1. A brassiere comprising:

a body having:

a front portion comprising a pair of breast receiving cups;

a closure between the pair of breast receiving cups;

a pair of side panels, each of the pair of side panels being connected to a different one of the pair of breast receiving cups;

an automatically adjustable back portion comprising at least two elasticized straps, each of the straps connected to each of the pair of side panels and opposite a front of the brassiere;

the body defining a first circumference about the torso of a wearer in a relaxed state; and when worn, the elasticized straps of the back portion automatically adjust to a second, greater circumference about the torso of the wearer.

2. The brassiere according to claim 1, wherein said elasticized sections are formed of a material selected from the group consisting of one or more elastic yarns, spandex, bare elasthane, nylon elasthane, polyester elastane, and any combination thereof.

3. The brassiere according to claim 1, wherein said at least two straps have an arrangement selected from the group consisting of one of said at least two straps overlapping the other of said at least two straps, and said at least two straps being parallel and non-overlapping.

4. A brassiere comprising:

a closure;

a pair of breast receiving cups connected by said closure;

a pair of elasticized side panels, each of said pair of side panels connected to one of said pair of breast receiving cups; and a dynamic adjustable back portion connected to each of said pair of elasticized side panels, wherein said dynamic adjustable back portion has a greater elasticity than said pair of side panels to permit elongation of the dynamic adjustable back portion from a first length to a second length to adjust a circumference of said brassiere during wear.

5. The brassiere according to claim 4, wherein the dynamic adjustable back portion has at least two straps.

6. The brassiere according to claim 5, wherein said at least two straps have an arrangement selected from the group consisting of one of said at least two straps overlapping the other of the straps, and said at least two straps being parallel and non-overlapping.

7. The brassiere according to claim 5, wherein one of said at least two straps is an elastic material.

8. The brassiere according to claim 7, wherein said elastic material is selected from the group consisting of one or more elastic yarns, spandex, bare elasthane, nylon elasthane, polyester elasthane, and any combination thereof.

9. A brassiere comprising:

a front portion comprising a pair of breast receiving cups and a closure therebetween;

a pair of elasticized side panels, each of the pair of side panels having a front end portion and a back end portion, the front end portion of one side panel being connected to a side of the front portion, and the front end portion of the other side panel being connected to an opposite side of the front portion;

an adjustable back portion having a higher degree of elasticity than the front portion and each of the side panels, and comprising two elasticized straps, each elasticized strap having opposed ends, the opposed ends of each strap extending between and connecting the back end portions of the side panels; and the front portion, side panels, and adjustable back portion form a first circumference in a relaxed state and, when worn, the elasticized straps of the adjustable back portion stretch about the torso of a wearer to form a second, greater circumference.

10. The brassiere according to claim 9, wherein said two elasticized straps have an arrangement selected from the group consisting of one of said two straps overlapping the other of the straps, and said two straps being parallel and non-overlapping.

11. The brassiere according to claim 9, wherein said elasticized straps are formed of a material selected from the group consisting of one or more elastic yarns, spandex, bare elasthane, nylon elasthane, polyester elasthane, and any combination thereof.

12. A brassiere comprising:

a front portion comprising a pair of breast receiving cups and a closure therebetween;

a pair of elasticized side panels, each of the pair of side panels having a front end portion and a back end portion, the front end portion of one side panel being connected to a side of the front portion, and the front end portion of the other side panel being connected to an opposite side of the front portion; and an adjustable back portion having a higher degree of elasticity than the front portion and each of the side panels, and comprising substantially parallel elasticized straps, each elasticized strap having opposed ends, the opposed ends of each strap extending between and connecting the back end portions of the side panels; and the front portion, side panels, and adjustable back portion form a first circumference in a relaxed state and, when worn, the elasticized straps of the adjustable back portion stretch about the torso of a wearer to form a second, greater circumference.

13. A brassiere comprising:

a front portion comprising a pair of breast receiving cups and a closure therebetween;

first and second elasticized side panels, each of the side panels having a front end portion and a back end portion, each back end portion having an upper portion and a lower portion, the front end portion of one side panel being connected to a side of the front portion, and the front end portion of the other side panel being connected to an opposite side of the front portion;

an adjustable back portion having a higher degree of elasticity than the front portion and each of the side panels, and comprising first and second elasticized straps, each elasticized strap having upper and lower opposed ends;

the lower end of the first elasticized strap being connected to the lower portion of the back end portion of the first side panel and the upper end of the first elasticized strap being connected to the upper portion of the back end portion of the second side panel;

the lower end of the second elasticized strap being connected to the lower portion of the back end portion of the second side panel and the upper end of the second elasticized strap being connected to the upper portion of the back end portion of the first side panel; and the front portion, side panels, and adjustable back portion form a first circumference in a relaxed state, and when worn, the elasticized straps of the adjustable back portion stretch about the torso of a wearer to form a second, greater circumference.

* * * * *